United States Patent [19]

Tachino

[11] 4,136,758

[45] Jan. 30, 1979

[54] SPEED CONTROL SYSTEM OF ELEVATOR

[75] Inventor: Kenzo Tachino, Inazawa, Japan

[73] Assignee: Mitsubishi Denki Kabushiki Kaisha, Tokyo, Japan

[21] Appl. No.: 853,886

[22] Filed: Nov. 22, 1977

[30] Foreign Application Priority Data

Dec. 1, 1976 [JP] Japan ..... 51-144339

[51] Int. Cl.[2] ..... B66B 1/30

[52] U.S. Cl. ..... 187/29 R

[58] Field of Search ..... 187/29

[56] References Cited

U.S. PATENT DOCUMENTS

| | | | |
|---|---|---|---|
| 3,552,524 | 1/1971 | Benjamin et al. | 187/29 |
| 3,670,851 | 6/1972 | Shima | 187/29 |
| 3,759,350 | 9/1973 | Caputo et al. | 187/29 |
| 3,893,695 | 7/1975 | Rickert | 187/29 X |

*Primary Examiner*—Robert K. Schaefer
*Assistant Examiner*—W. E. Duncanson, Jr.
*Attorney, Agent, or Firm*—Oblon, Fisher, Spivak, McClelland & Maier

[57] ABSTRACT

In a speed control system of elevator, a first speed pattern being an integration of an acceleration pattern and a second speed pattern decreasing at a constant speed for the remaining distance till the stoppage point, are set up. The car is operated in accordance with the first speed pattern. When the car reaches the decelerating point, the car is operated in accordance with the first speed pattern before the first and second speed patterns are not coincident, and then in accordance with the second speed pattern after they are coincident. A comparator is provided to detect the difference between the first and second speed patterns. When the car reaches the deceleration point, the acceleration pattern is successively reduced stepwisely in accordance with the output of the comparator. The reducing of the acceleration pattern is integrated and the result of the integration is used as the first speed pattern.

5 Claims, 5 Drawing Figures

SPEED CONTROL SYSTEM OF ELEVATOR

BACKGROUND OF THE INVENTION

The present invention relates to a speed control system of elevator.

In depicting a speed pattern of elevator, it is desirable that, as shown in FIG. 1, the maximum accelerating values (the absolute values of acceleration) at the accelerating and decelerating times are previously set at a fixed values a1 and a2 and a speed pattern Vo Va Vb Vc Vd Ve is formed so that the acceleration pattern depicts a pattern Ao Aa Ab Ac Ad Ae, for example. The maximum acceleration (the absolute value of acceleration) at the deceleration is independent of the type of operations. With the reference of the time that the car reaches a target stoppage position, the speed pattern for an acceleration pattern A'o A'a A'b A'c Ad Ae is V'o V'a V'b V'c Vd Ve and the speed pattern for an acceleration pattern A"o A"a A"b A"c Ad Ae is V"o V"a V"b V"c Vd Ve. These speed patterns are laid on a straight line V Vc V'c V"c Vd as indicated by a broken line in the constant acceleration region at the deceleration.

The car is accelerated along a speed pattern Vo Va Vb and as it reaches the deceleration decision point Vb, a speed pattern Vb Vc of the time reference as shown is generated. At this time, various factors cause it to deviate from the speed pattern V Vc Vd at the point Vc, to possibly cross the latter. In such a case, the car is shocked to result in the discomfort of passengers.

SUMMARY OF THE INVENTION

Accordingly, the primary object of the invention is to provide a speed control system of elevator by which two speed patterns smoothly overlap each other to eliminate a shock to the car and thus to ensure the comfort of passengers, with a view to overcoming the above-mentioned disadvantages.

According to one aspect of the invention, there is provided a speed control system of elevator. In the system, a first speed pattern being an integration of an acceleration pattern and a second speed pattern decreasing at a constant speed for the remaining distance till the stoppage point, are set up. The car is operated in accordance with the first speed pattern. When the car reaches the decelerating point, the car is operated in accordance with the first speed pattern before the first and second speed patterns are not coincident, and then in accordance with the second pattern after they are coindident. A comparator is provided to detect difference between the first and second speed patterns. When the car reaches the deceleration point, the acceleration pattern is successively reduced stepwisely in accordance with the output of the comparator. The reducing of the acceleration pattern is integrated and the result of the integration is used as the first speed pattern.

The present invention will be better understood from the following description taken in connection with the accompanying drawings, in which:

DESCRIPTION OF THE PREFERRED EMBODIMENT

An embodiment of the invention will be given with reference to FIGS. 2 through 4.

Figure 1:
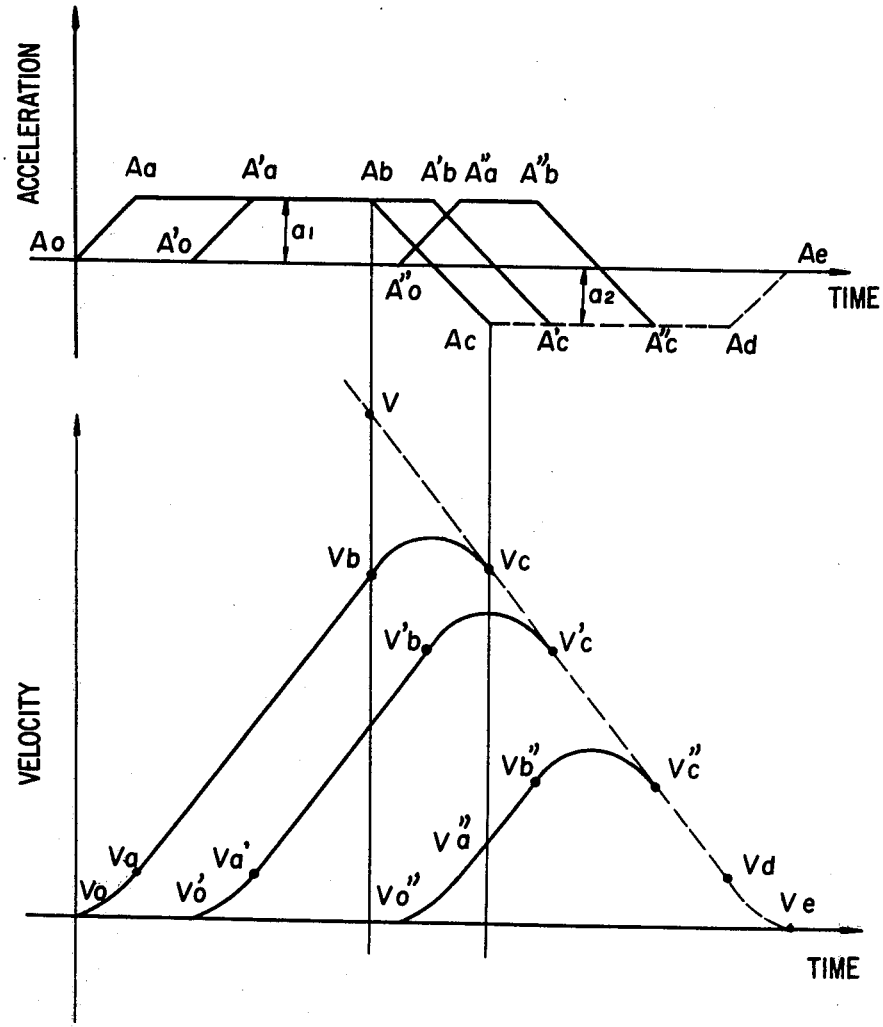
FIG. 1 shows a couple of graphs to illustrate the relationship of acceleration pattern vs. speed pattern of elevator.
Figure 2:
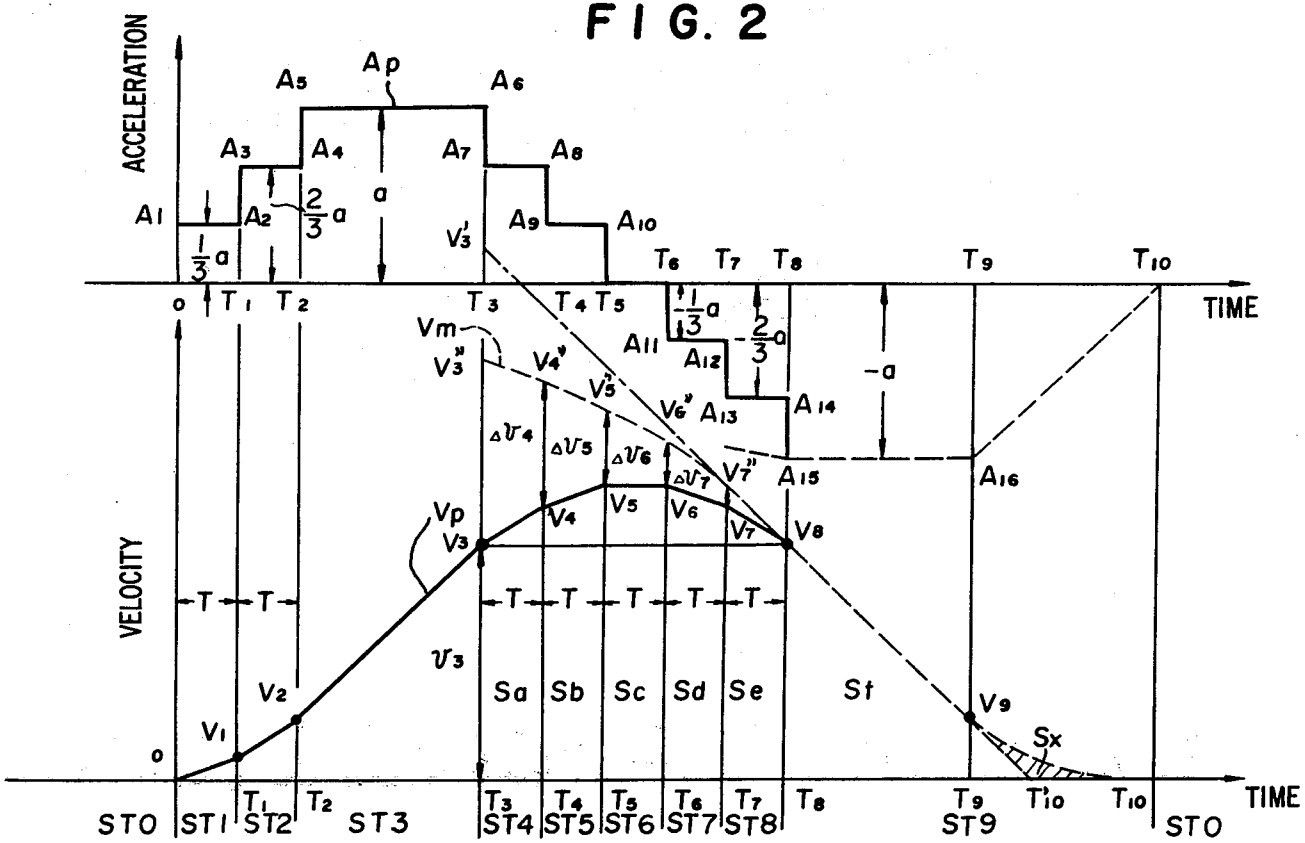
FIG. 2 is a couple of graphs to illustrate the relationship of acceleration pattern vs. speed pattern of an embodiment of a speed control system of elevator according to the invention.

In FIG. 2, Ap designates an acceleration pattern of three-step staircase shape in which the absolute values of the maximum accelerations at acceleration and deceleration are designated by a and each step has an acceleration interval $\frac{1}{3}a$ and an equal time interval T (generally, increase of number of steps makes the speed pattern smooth.) Vp designates a first speed pattern.

For easy of explanation, the operating condition of elevator will be divided into 10 regions: the stoppage region designated by ST0; the acceleration $\frac{1}{3}a$ region from start time 0 to time $T_1$ by $ST_1$; the acceleration $\frac{2}{3}a$ region from $T_1$ to $T_2$ by $ST_2$; the maximum acceleration a region by $ST_3$ continuous to the time $T_3$ to start the deceleration to stop the car at the stop target floor position (hereinafter referred to as a stoppage point); the acceleration $\frac{2}{3}a$ region continuing its seccessive decelaration to time $T_4$ by $ST_4$; the acceleration $\frac{1}{3}a$ continuous till time $T_5$ by $ST_5$; the acceleration 0 region till $T_6$ by $ST_6$; the negative acceleration $-\frac{1}{3}a$ continuous to time $T_7$ by $ST_7$; the negative acceleration $-\frac{2}{3}a$ region till time $T_8$ by $ST_8$; ;the region designated by $ST_9$ including the acceleration $-a$ region and another region where the acceleration rectilinearly changing from $-a$ to 0 for car stop. Further, an instruction speed value at a point $V_3$ on the first speed pattern Vp at time $T_3$ is represented by character $V_3$; instruction speed values at points $V_4$ $V_9$ by characters $V_4$ to $V_9$. The car running distances in the respective regions $ST_4$ to $ST_8$ (for example, the running distance of $ST_4$ corresponds to the area defined by $T_3$, $V_3$, $V_4$, $T_4$ and $T_3$) are designated by characters Sa, Sb, Sc, Sd and Se, respectively. The distance of the region $ST_9$ corresponding to a triangle area defined by $T_8$, $V_8$, $T'_{10}$ and $T_8$ is denoted by Sf. The area enclosed by Sf, $T'_{10}$, $V_9$, $T_{10}$ and $T'_{10}$ by Sx. These instruction speed values and areas are given below $$V_3 = \sqrt{2aSf}$$

$$V_4 = V_7 = V_3 + \tfrac{2}{3}aT$$

$$V_5 = V_6 = V_4 + \tfrac{1}{3}aT = V_3 + aT$$

$$Sa = Se = \tfrac{1}{3}aT^2 + V_3T$$

$$Sb = Sd = 5/6aT^2 + V_3T$$

$$Sf = aT^2 + V_3T$$

The remaining distances at time $T_4$ to $T_8$ till the stoppage point, designated by $S_4$ to $S_8$ are given $$S_8 = Sf + Sx$$

$$S_7 = Sf + Sx + Se = Sf + Sx + \tfrac{1}{3}aT^2 + V_3T$$

$$S_6 = Sf + Sx + Se + Sd = Sf + Sx + 7/6\,aT^2 + 2V_3T$$

$$S_5 = Sf + Sx + Se + Sd + Sc = Sf + Sx + 13/6\,aT^2 + 3V_3T$$

$$S_4 = Sf + Sx + Se + Sd + Sc + Sb = Sf + Sx + 3aT^2 + 4V_3T$$

The rectilinear speed pattern $\overline{V'_3\,V_8\,V_9\,V'_{10}}$ indicated by dotted and alternate long and short dash lines is given by an equation (1) with respect to the remaining distance Sr till the stoppage point when the car is decelerated at a fixed negative acceleration $-a$.

$$V = \sqrt{2a(Sr\text{-}Sx)} \qquad (1)$$

The remaining distance $S_3$ at time $T_3$ to start to reduce the acceleration in order to stop the car at the stoppage point, is given $$S_3 = Sf + Sx + Sa + Sb + Sc + Sd + Se$$

The distance $S_3$ is smaller than the area defined by $T_3$, $V'_3$, $V_9$, $T_{10}$ and $T_3$. The speed curve obtained by substituting the respective remaining distances at times $T_3$ to $T_8$ into the function of the speed distance by the equation (1), is traced to be a broken line $V''_3\,V''_4\,V''_5\,V''_6\,V''_7\,V_8$.

Speed differences $\overline{\Delta V_4,\ \Delta V_5,\ \Delta V_6,\ \text{and}\ \Delta V_7}$ at times $T_4$ to $T_7$ between the curves $\overline{V''_3\,V''_4\,V''_5\,V''_6\,V''_7\,V''_8}$ and $\overline{V_3\,V_4\,V_5\,V_6\,V_7\,V_8}$ are $$\Delta V_4 = \sqrt{2a(S_4\text{-}Sx)} - V_4 = \sqrt{V_3^2 + 3aT^2 + 4V_3T} - V_3 - \tfrac{3}{2}aT$$

$$\Delta V_5 = \sqrt{2a(S_5\text{-}Sx)} - V_5 = \sqrt{V_3^2 + 13/6aT^2 + 3V_3T} - V_3 - aT$$

$$\Delta V_6 = \sqrt{2a(S_6\text{-}Sx)} - V_6 = \sqrt{V_3^2 + 7/6aT^2 + 2V_3T} - V_{_} - aT$$

$$\Delta V_7 = \sqrt{2a(S_7\text{-}Sx)} - V_7 = \sqrt{V_3^2 + \tfrac{1}{3}aT^2 + V_3T} - V_3 - \tfrac{2}{3}aT$$

The speed differences $\Delta V_4$, $\Delta V_5$, $\Delta V_6$ and $\Delta V_7$ are the function of the instruction speed value $V_3$ at the stoppage decision time $T_3$ and become large as the value $V_3$ is large.

Let us now study deviation of the speed difference depending on the instruction speed value $V_3$ at the stoppage decision point. When $T = 0.4$ sec and $a = 1.0$ m/sec$^2$, in the car operation for one floor interval of 3 m, the instruction speed value $V_3$ is approximately 1.0 m/sec and, when the rating speed is 10 m/sec, the $V_3$ is 9.6 m/sec to reach the rating speed. When the speed differences of the respective cases, e.g. $\Delta V_4$ is calculated, we obtain $\Delta V_4 \approx 1.23$ for one floor interval operation and $\Delta V_4 = 1.53$ for the operation to reach the rating speed. Therefore, the speed deviation is only about 20%.

The speed differences $\Delta V_4$, $\Delta V_5$, $\Delta V_6$ and $\Delta V_7$ in an ideal one floor interval operation are previously set up. At time $T_3$ of the stoppage decision point $V_3$, the acceleration is reduced from the maximum value a to $\frac{2}{3}$a. A second speed pattern Vm previously stored in terms of the function of speed and distance and the first speed pattern Vp are compared Along the speed value, relating to the speed corresponding to the remaining distance. Then, as the difference therebetween equals the pregiven speed difference $\Delta V_4$, the acceleration is reduced to be $\frac{1}{3}$a. And when the speed difference thus obtained equals the $\Delta V_5$, the acceleration is reduced to be zero. In this manner, this comparing process will be repeated for the respective pregiven speed differences $\Delta V_4$, $\Delta V_5$, $\Delta V_6$, and $\Delta V_7$. along with this, the acceleration is reduced successively as of $\overline{A_6\,A_7\,A_8\,A_9\,A_{10}}$. This reducing acceleration is integrated to obtain the first speed pattern Vp.

Finally, in the region $ST_8$ of the acceleration $-\frac{2}{3}$a, if the acceleration maintains its $-\frac{2}{3}$a, both the speed patterns Vp and Vm will necessarily cross since the acceleration of the second speed pattern Vm is $-a$. Accordingly, after the speed values of both the speed patterns Vp and Vm coincide each other, the second speed pattern Vm is treated as the instruction speed pattern. As a result, the speed pattern is smoothly changed without being accompanied by the discomfort of passengers, from the first speed pattern of time reference at the acceleration to the second speed pattern of distance reference at the deceleration, and additionally the car lands at the stoppage point with a high accuracy.

Incidentally, the speed/distance function of the second speed pattern previously stored must be the one taking account of the time lag of the elevator control system.

Figure 3:
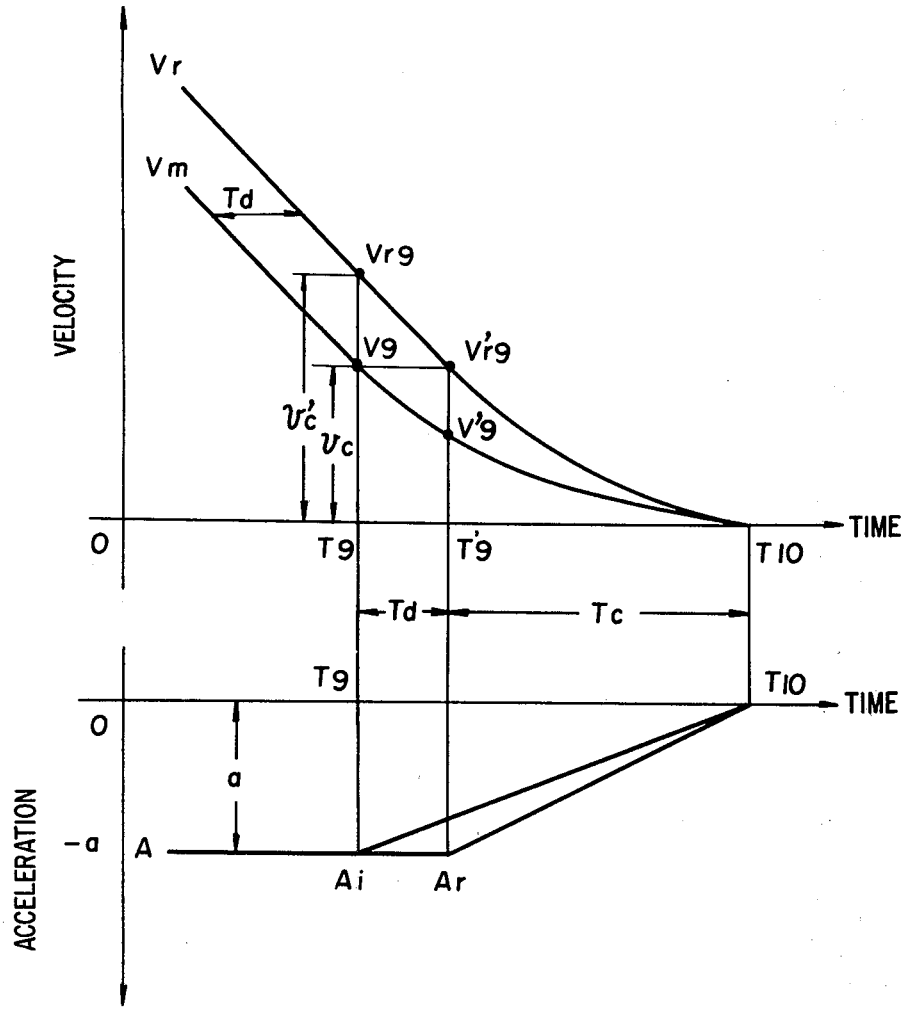
FIG. 3 is a set of graphs to illustrate the relationship of the speed pattern immediately before the car stops and the car speed and the acceleration pattern.

Referring to FIG. 3, an example will be described of the speed/distance function of the second speed pattern Vm to be stored.

In the figure, $\overline{Vm\ V_9\ V'_9\ T_{10}}$ is the second speed pattern, $\overline{Vr\ Vr_9\ Vr_9\ T_{10}}$ an actual speed of the car, $\overline{A\ Ar\ T_{10}}$ the acceleration of the second speed pattern, and $\overline{A\ Ar\ T_{10}}$ an actual acceleration of the car.

In this example, it is assumed that the time delay of the elevator control system in the fixed acceleration region of a acceleration is constant with Td, the acceleration of the second speed pattern and the car acceleration exhibit a rectilinear decrease, and the time lag is reduced zero at the time $T_{10}$ the car lands the stoppage point. That is, the second speed pattern $\overline{V_9\ V'_9\ T_{10}}$ and the actual speed pattern $\overline{Vr'_9\ T_{10}}$ are of the second order curve. With designation of Tc for the time interval between time points, $T'_9$ and $T_{10}$, Vc for the second speed value at time $T_9$, and V'c for the actual speed of the car, the following relations hold $$Vc = \tfrac{1}{2}\,aTc$$

$$V'c = Vc + aTd$$

The remaining distances from the time points $T_9$ and $T'_9$ to the stoppage point (corresponding to the area defined by $T_9\ Vr_9\ T_{10}\ T_9$ and $T'_9\ V'r_9\ T_{10}\ T'_9$), designated by $S_9$ and $S'_9$ are $$S_9 = 1/6aTc^2 + \tfrac{1}{2}a\,(Tc + Td)\,Td$$

$$S'_9 = 1/6aTc^2$$

Accordingly, the speed/distance function to be stored is given below with designation of Sr for the remaining distance till the stoppage point and Vm for the stored speed.

In the region $0 \leqq Sr < S'_9$ $$Vm = \frac{aTc}{2(Tc + Td)^2}\left(\frac{6TcSr}{a}\right)^{\frac{1}{2}}$$

In the region $S'_9 \leqq Sr < S_9$ $$Vm = \frac{aTc}{2(Tc + Td)^2}\left(\sqrt{\frac{2(Sr - S'a)}{a} + \frac{Tc^2}{4}} + \frac{Tc}{2}\right)^2$$

In the region $S_9 \leqq Sr$ $$Vm = \sqrt{2a(Sr - S_9) + (\tfrac{1}{2}aTc + aTd)^2} - aTd$$

Figure 4:
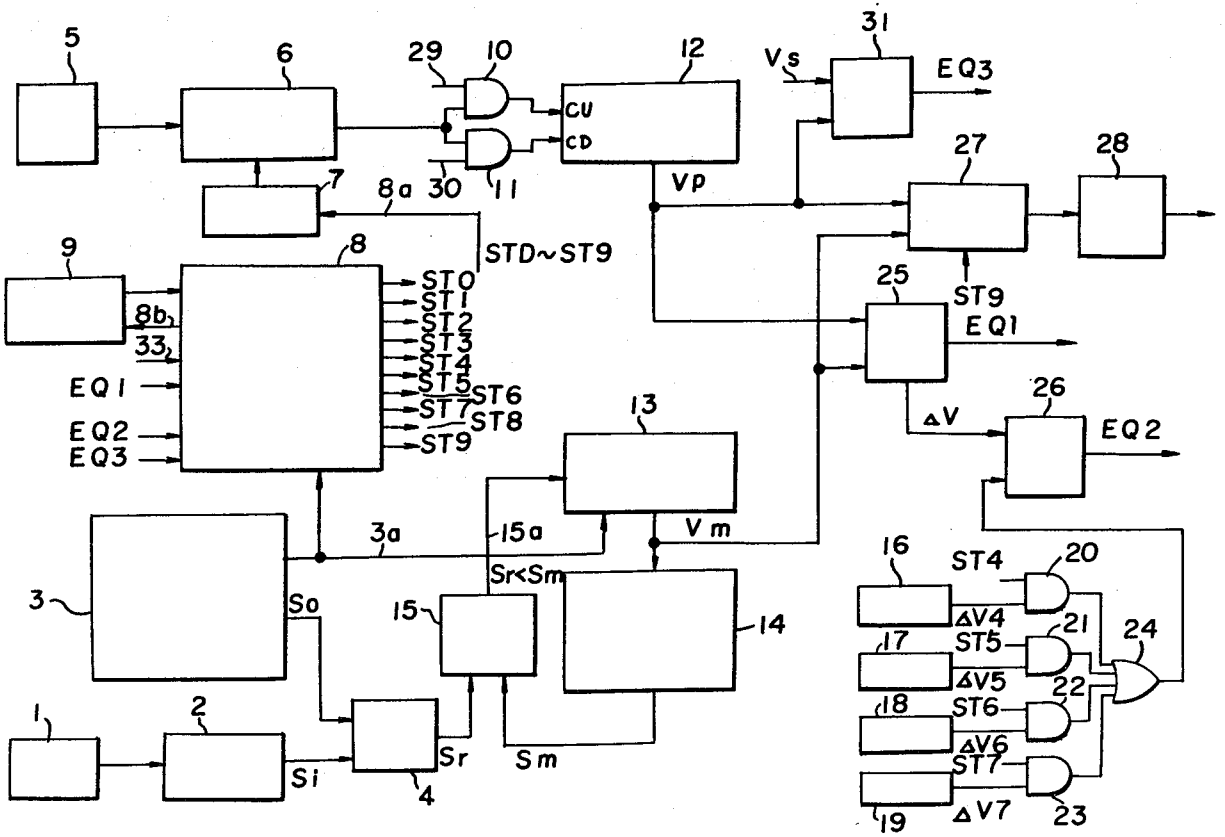
FIG. 4 is a block diagram of an embodiment of the speed control apparatus of elevator according to the invention.

In FIG. 4, (1) designates a position pulse generator for generating pulses proportional to the actual moving distance of the car, (2) a car position detector for detecting the current position Si of the car which is a relative position from the reference position (generally, the lowermost floor position or the uppermost floor position), (3) a stop decision apparatus for computing a time point to reduce acceleration so as to stop the car at a target floor, for example, the time $T_3$ in FIG. 2, and the target floor position, and then for producing a stop decision signal (3a) and a stoppage point position signal So, (4) a remaining distance calculator for calculating the difference between the current position Si and the stoppage point position So to produce the remaining distance Sr till the stoppage point, (5) an acceleration pulse generator for generating acceleration pulses with a fixed frequency, (6) a modulator, and (7) an acceleration value setter. The frequency of the acceleration pulses outputted from the acceleration pulse generator (5) is modulated by the modulator with the frequency corresponding to the acceleration value set by the acceleration value setter (7). Reference numeral (8) designates a calculation instruction signal generator for generating signals (referred to as regional signals) corresponding to the respective operation regions $ST_0$ to $ST_9$ representing those in FIG. 2. (9) designates a timer for calculating the regional times T of the regions $ST_1$ and $ST_2$, and the operational regions $ST_4$ and $ST_5$ of the operations after the rating speed is reached. (10) and (11) are AND gates, (12) and (13) up/down counters, (12) a first speed counter for outputting the first speed pattern Vp and (13) a second speed counter for outputting the second speed pattern Vm, and (14) is a speed/distance function memory. The memory (14) is a read only memory for storing the remaining distance till the stoppage point in terms of the function of the speed/distance, as indicated by the curve $V''_3 V_8 V_9 T_{10}$ shown in FIG. 2, and producing a stored distance Sm in response to the addressing by the second speed pattern Vm of the output from the second speed counter (13). (15) is a first comparator for comparing the remaining distance Sr with the memory distance Sm. The comparator produces a count signal (15*a*) toward the second speed counter (13) when Sr<Sm. (16) to (19) are speed difference registers for registering therein the speed differences $\Delta V_4$, $\Delta V_5$, $\Delta V_6$, and $\Delta V_7$ between the first speed pattern Vp and the second speed pattern Vm shown in FIG. 2, respectively. (20) to (23) are AND gates, (24) an OR gate, (25) a second comparator for comparing the first speed pattern Vp and the second speed pattern Vm to produce the speed difference $\Delta V$ and a coincidence signal $EQ_1$, (26) a third comparator for comparing the speed difference $\Delta V$ with those $\Delta V_4$, $\Delta V_5$, $\Delta V_6$, $\Delta V_7$ of the outputs of the OR gate (24), and (27) an instruction selector for selecting the first speed pattern Vp and the second speed pattern Vm. The instruction speed signal selected by the selector is converted by a D/A converter (28) into an analogue instruction voltage to be outputted toward a drive circuit (not shown). (29) and (30) are an acceleration signal and a deceleration signal. (31) is a fourth comparator for comparing a speed signal Vs so as to prevent the first speed pattern Vp from exceeding the rating speed with the first speed pattern Vp to produce a coincidence signal $EQ_3$. (33) is a starting signal.

The operation not yet reaching the rating speed will be given with reference to FIGS. 2 and 4. Upon receipt of the starting signal (33), the calculation instruction signal generator (8) stops the regional signal STO thus far generated and generates the succeeding regional signal $ST_1$; after time T previously set by the timer (9), the regional signal is changed to the succeeding one $ST_2$; after the time T, the signal is succeeded by $ST_3$. In this manner, the calculation instruction signal generator (8) generates successively the respective regional signals of the speed pattern in FIG. 2.

In response to the regional signals $ST_0$ to $ST_9$, the acceleration setter (7) produces the acceleration $\frac{1}{3}a$ for the regional signals $ST_1$, $ST_5$ and $ST_7$, the acceleration 2/3a for $ST_2$, $ST_4$ and $ST_8$ and the acceleration a for $ST_3$. In the modulator (6), the acceleration pulse of the acceleration pulse generator (5) is modulated by the frequency corresponding to the acceleration value set by the acceleration value setter (7). The acceleration pulses modulated passes through the AND gate (10) to the countup input of the first speed counter (12). In the accelerating region from $ST_1$ to $ST_5$, the acceleration signal (29) enables the AND gate (10). The acceleration pulse drives the first speed counter (12) to produce the first speed pattern Vp shown in FIG. 2. In the regions other than the region $ST_9$, the instruction selector (27) selects the first speed pattern Vp which in turn is converted into an analogue signal instruction voltage by the D/A converter (28) which in turn is directed to the drive circuit. The stoppage decision apparatus (3) calculates the time $T_3$ to reduce the acceleration in order to stop the car at the stoppage point, and produces the stoppage decision signal (3a) and the stoppage position signal So.

The stoppage decision signal (3*a*) causes the calculation instruction signal generator (8) to switch from the regional signal $ST_3$ to the ensuing one $ST_4$. And the maximum value is preset at the output of the second speed counter (13). The remaining distance calculator (4) calculates the remaining distance Sr which is the difference between the stoppage point So and the current car position Si. After the stoppage is decided, in the region $ST_4$, the output of the second speed counter (13) is immediately preset the maximum value. The stored distance Sm corresponding to the speed value and the remaining distance Sr are compared by the first comparator (15), In the comparison, when Sr<Sm, the first comparator (15) generates a count-down signal (15*a*) to the second speed counter (13). At this time, the second speed counter (13), the memory (14) and the first comparator (15) are looped. Accordingly, when the stoppage decision signal (3a) is issued, the stored distance Sm is immediately set smaller than the remaining distance Sr but closest to the remaining distance Sr, i.e. at $V''_3$ of FIG. 3. Then, the first speed counter (12) counts acceleration pulses with the frequency corresponding to the acceleration $\frac{2}{3}a$. As a result, the first speed pattern Vp of the output continuously increases while the remaining distance Sr till the stoppage point decreases. And the stored distance Sm decreases and the second speed pattern Vm also decreases. The second speed pattern Vm and the first speed pattern Vp are compared in the second comparator (25) and then the second comparator produces the speed difference $\Delta V$ toward the third comparator (26).

In the speed difference registers (16) to (19), the speed difference signals $\Delta V_4$, $\Delta V_5$, $\Delta V_6$ and $\Delta V_7$ corresponding to the speed differences $\Delta V_4$, $\Delta V_5$, $\Delta V_6$ and $\Delta V_7$ previously set up are stored. After the stoppage is decided, in the region $ST_4$, the regional signal $ST_4$ enables the AND gate (20) to permit the speed signal $\Delta V_4$ to pass through the AND gate (20) and the OR gate (24) to enter into the third comparator (26). In the comparator (26), the speed difference signals $\Delta V$ and $V_4$ are compared. In the comparison, when both are coincident, it produces the coincidence signal $EQ_2$. The calculation instruction signal generator (8) receives the coincidence signal $EQ_2$ to change the regional signal $ST_4$ to the ensuing one $ST_5$. The regional signal enables the AND gate (21) to permit the speed difference signal $\Delta V_5$ to pass through the AND gate (21) and the OR gate (24) to reach the third comparator (26). In the comparator, it is compared with the speed difference signal $\Delta V$ and when these are equal, it produces the coincidence signal $EQ_2$ again. In this manner, in the region $ST_6$, the speed difference signal $\Delta V_6$ goes through the AND gates (22) to the OR gate (24). In the region $ST_7$, the speed difference signal $\Delta V_7$ goes through the AND gate (23) to the OR gate (24). Then, these speed difference signals, respectively, are compared with the speed difference signal $\Delta V$ between the first speed pattern Vp and the second speed pattern Vm, in the third comparator (26). Each time these are coincident, the operation region is switched to the succeeding one. In the acceleration value setter (7), the accelerations defined for the respective regions as shown in FIG. 2. are set up, and the modulator (6) produces acceleration pulses with the frequency corresponding to the acceleration value set up by the acceleration value setter (7). In the deceleration regions $ST_7$ and $ST_8$, the deceleration signal (30) conditions the AND gate (11) to permit the acceleration pulse to enter the count-down input of the first speed counter (12). In this way, the first speed counter (12) produces at the output the deceleration pattern $\overline{V_6}\,\overline{V_7}\,\overline{V_8}$ as shown in FIG. 2.

In the circuit loop including the second speed counter (13), the speed/distance function memory (14) and the first comparator (15), the speed/distance function (14) produces the stored distance Sm equal to the remaining distance till the stoppage point, with the result that the second speed pattern Vm of the address of the speed/distance function memory (14) is obtained as an ideal deceleration instruction pattern corresponding to the remaining distance of the curve $V''_3\,V_8\,V_9\,T_{10}$ shown in FIG. 2.

Generally, when the instruction speed against the remaining speed, the speed value is stored in the memory and it is addressed by the remaining distance. In this case, the speed is stored with equal distance intervals so that the Intervals of memory speed in the low speed region are widened, thus needing a large capacity of the memory. On the other hand, the circuit loop including the second speed counter (13), the speed/distance memory (14) and the first comparator (15) is used and the remaining distance is stored in the memory (14) and the speed is obtained at the output of its address counter. In this method of the invention, the speed stored in the memory is equi-interval as a result and thus the memory capacity is saved.

Succeedingly, in the region $ST_8$, the acceleration of the first speed pattern Vp is $-\frac{2}{3}a$ and the acceleration of the second speed pattern Vm is $-a$ so that both speed curves of necessity cross each other. The cross point is detected by the second comparator (25) and the coincidence signal $EQ_1$ between the Vp and Vm is fed to the calculation instruction signal generator (8) to change the region to the succeeding region $ST_9$. After this, in response to the regional signal $ST_9$, the instruction speed selector (27) selects the second speed pattern Vm as the instruction speed and the speed pattern as indicated by the broken line of $V_8\,V_9\,T_{10}$ in FIG. 2 is converted into an analogue speed instruction voltage to be directed to the drive circuit (not shown). The result is that the elevator car smoothly and accurately lands the target floor.

Figure 5:
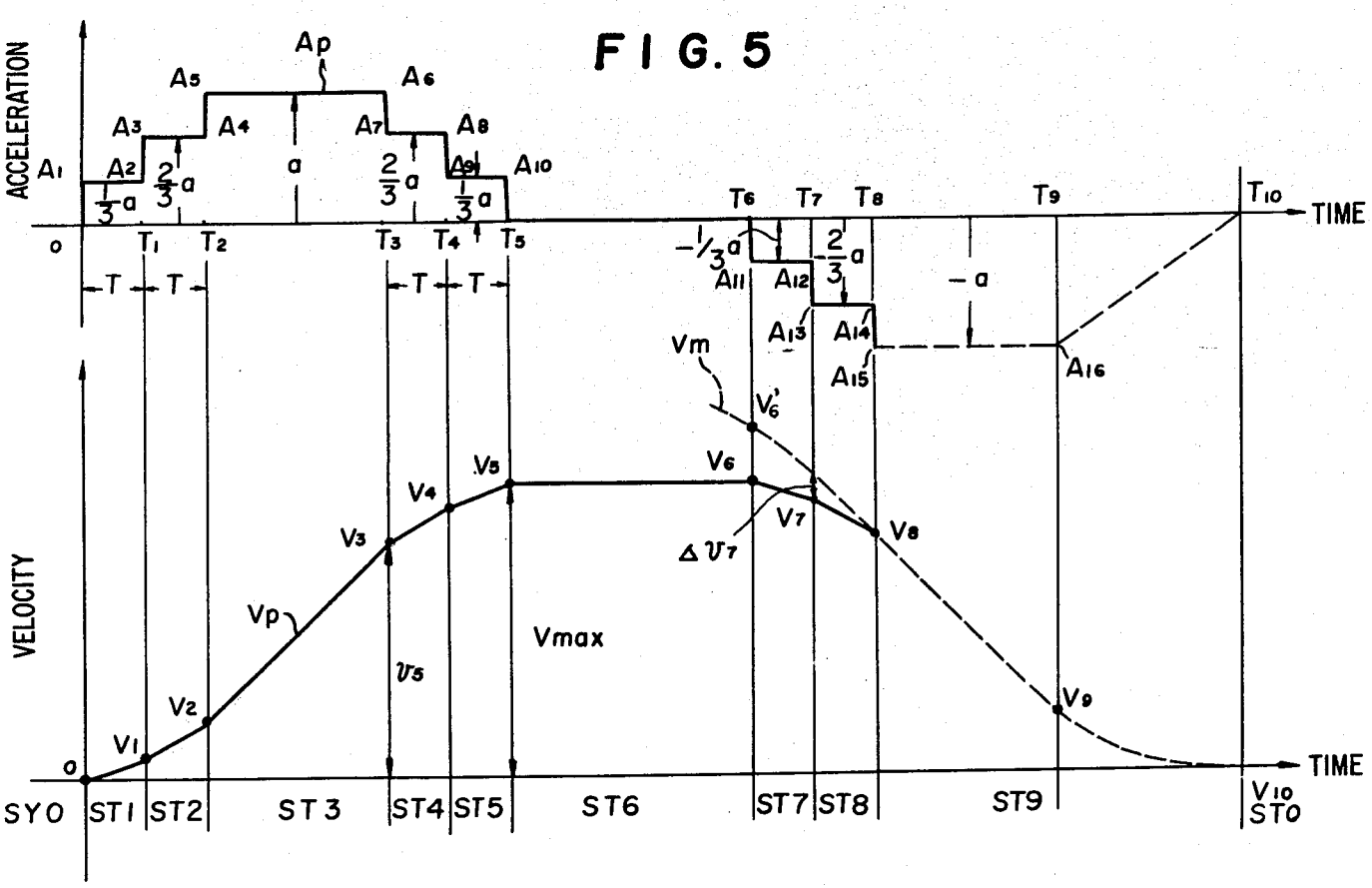
FIG. 5 is a set of graph for illustrating the relationship of acceleration pattern and speed pattern when the speed reaches the rating speed in the embodiment of the invention.

The explanation to follow is the operation to reach the rating speed Vmax as shown in FIG. 5.

The operation from issue of the starting signal (33) to the region $ST_3$ is the same as of not yet reaching the rating speed mentioned above. Thus, the explanation thereof will be omitted here. In the region $ST_3$, the first speed pattern of the output of the first acceleration counter (12) shown in FIG. 4 continues its increase at the maximum acceleration a. And if the speed pattern is generated along with the acceleration pattern $A_6\,A_7\,A_8\,A_9\,A_{10}\,T_5$ shaped a staircase with the acceleration interval $\frac{1}{3}a$ and with the time interval T shown in FIG. 5, the speed value Vs at the point (the $V_3$ point of time $T_3$ in FIG. 5) to reduce the acceleration so that the instruction speed value does not exceed the rating speed Vmax, is given $$Vs = Vmax - aT$$

Accordingly, the speed Vs preset and the first speed pattern Vp are compared in the fourth comparator (31) and when these are coincident, the coincident signal $EQ_3$ is outputted to the calculation instruction signal generator (8) thereby to change the region to $ST_4$. In the succeeding regions $ST_4$ and $ST_5$, the timer (9) provides an automatic change of the region each time interval T.

The acceleration pulses with the frequency corresponding to the acceleration $\frac{2}{3}a$ and $\frac{1}{3}a$ of each region is outputted from the modulator (6). Then, they are counted by the first acceleration counter (12) to be produced therefrom the speed pattern $V_3\,V_4\,V_5$ to enter the rating speed Vmax region $ST_6$. In the $ST_6$ region, the accelerating pulses are not inputted to the first acceleration counter (12) so that the output of the first acceleration counter (12) maintains the rating speed Vmax. In the stoppage decision apparatus (3), the point to reduce the acceleration to stop at the stoppage point has been calculated and when it produces the stoppage decision signal (3a) at time $T_6$ in FIG. 5, the region is immediately switched to $ST_3$ and the acceleration also is switched to $-\frac{1}{3}a$. Accordingly, the first speed counter (12) starts to produce the deceleration pattern $V_6\,V_7$. At this time, the stored distance Sm equal to the remaining distance Sr till the stoppage point is outputted from the speed-distance function memory (14) and the second acceleration counter (13) produces the second speed pattern Vm at the point $V'_6$ in FIG. 5. Then, deceleration is performed at the acceleration $-\frac{1}{3}a$. The speed difference $\Delta V$ between the first speed pattern Vp and the second speed pattern Vm is compared in the third comparator (26) with the preset speed difference $\Delta V_7$ to provide the coincident signal $EQ_2$. The coincident signal $EQ_2$ switches the regional signal to the succeeding one $ST_8$. As described above, in the operation to reach the rating speed Vmax, switching from $ST_4$ to $ST_5$ and from $ST_5$ to $ST_6$ is automatically made after time lapse of T set by the timer (9). The switching of the region by comparing the speed difference after the stop is decided is made one time only from the region $ST_7$ to the next region $ST_8$. Except this, the circuit operation under consideration is the same as of the operation of not yet reaching rating speed Vmax, thus omitting the explanation thereof. It is clear that when the step number of the acceleration pattern is increased, the first and second patterns become smoother.

As described above, in the present invention, the difference between the first speed pattern of time reference and the second speed pattern of speed-distance reference are detected. After the car reaches the deceleration decision point, the acceleration pattern is successively reduced stepwisely in accordance with the above-mentioned comparison value. The reducing of the acceleration pattern is integrated and the result of it is used as the first speed pattern. Before the first and second speed patterns are not coincident, the car is operated in accordance with the first speed pattern. After the coincidence therebetween, the car is operated in accordance with the second speed pattern.

With such a scheme, the first and second speed patterns are smoothly overlapped with the result that none of shock is given to the car with the comfort of passengers.

What is claimed is:

1. A speed control system of elevator in which a first speed pattern being an integration of an acceleration pattern and a second speed pattern decreasing at a constant acceleration for the remaining distance till the stoppage point, are set up, and a car is operated in accordance with the first speed pattern, and when the car reaches a deceleration decision point, the car is controlled in accordance with the first speed pattern before the first and second speed patterns are not coincident and then in accordance with the second speed pattern after they are coincident, in which comparing means for detecting the difference between said first and second speed pattens is provided and, after the car reaches said deceleration point, said acceleration pattern is successively reduced stepwisely in accordance with the output of said comparator and integration of the reducing thereof is used as said first speed pattern.

2. A speed control system according to claim 1, in which said accelration pattern is reduced each time the output of said comparator reaches a given value.

3. A speed control system according to claim 1, in which said second speed pattern is obtained from a read only memory storing the speed for the remaining distance till the stoppage point in terms of a speed-distance function.

4. A speed control system according to claim 3, in which said second speed pattern is obtained from a counter which is driven by difference between the output of said read only memory and the remaining distance till the stoppage point and provides an address signal to said read only memory.

5. A speed control system according to claim 1, in which, when the car is operated at a rating speed, said acceleration pattern is successively reduced stepwisely regardless of said second speed pattern until the speed reaches the rating speed and the integration of the reducing thereof is used as said first speed pattern.

* * * * *